United States Patent [19]

Botzler

[11] 4,236,442

[45] Dec. 2, 1980

[54] DIGITALLY COMPATIBLE SERVOMOTOR

[75] Inventor: Ludwig Botzler, Munich, Fed. Rep. of Germany

[73] Assignee: Messerschmitt-Boelkow-Blohm Gesellschaft mit beschraenkter Haftung, Munich, Fed. Rep. of Germany

[21] Appl. No.: 970,739

[22] Filed: Dec. 18, 1978

[30] Foreign Application Priority Data

Dec. 23, 1977 [DE] Fed. Rep. of Germany ..... 2757612

[51] Int. Cl.[3] ..... F15B 9/10

[52] U.S. Cl. ..... 91/375 R; 91/380; 92/110; 92/113

[58] Field of Search ..... 91/375 R, 380; 92/110, 92/113

[56] References Cited

U.S. PATENT DOCUMENTS

| | | | |
|---|---|---|---|
| 1,595,939 | 8/1926 | Hukill et al. | 92/113 X |
| 1,822,667 | 9/1931 | Proell | 91/375 |

FOREIGN PATENT DOCUMENTS

| | | | |
|---|---|---|---|
| 2413946 | 10/1975 | Fed. Rep. of Germany . | |
| 2502832 | 10/1975 | Fed. Rep. of Germany . | |
| 2502833 | 8/1975 | Fed. Rep. of Germany . | |
| 561811 | 6/1944 | United Kingdom | 91/375 |
| 153353 | 5/1963 | U.S.S.R. | 92/113 |

*Primary Examiner*—Robert L. Bleutge

*Attorney, Agent, or Firm*—W. G. Fasse; D. F. Gould

[57] ABSTRACT

The present servomotor has a working piston in a piston cylinder. The working piston is connected to a spindle having a relatively high pitch. The spindle is attached at one end thereof to a control disk system comprising three control disks. The two outer control disks are rigidly connected to the spindle, and the central control disk is connected to a digital stepping motor. The central disk is arranged between the two outer control disks so that the central disk may rotate substantially free of play, whereby the rated position of a stepping drive motor corresponds precisely to the actual position of a linear output member, such as a piston rod.

10 Claims, 6 Drawing Figures

DIGITALLY COMPATIBLE SERVOMOTOR

BACKGROUND OF THE INVENTION

The present invention relates to a digitally compatible servomotor with a reversible digital stepping motor, preferably a hydraulic or pneumatic stepping motor.

Hydraulic servomotors are known in many different versions. The German Patent Publication (DOS) No. 2,413,946 discloses, for example, an apparatus the actuating mechanism of which is connected to a tripping device by a single control conduit. The tripping device is connected to the working member through a pressure line or conduit. The tripping device comprises a rotationally movable piston arranged in a cylinder wherein said piston rotates stepwise about its longitudinal axis. Each rotational step positioning of the piston alternately releases a connection between the control conduit and a pressure line. Such a servomotor arrangement is not only expensive to construct, the resolution capability of the servocylinder is not optimal because of the relatively large stepping increments.

Hydraulic gearing mechanisms for effecting alternating movements are also known already. The German Patent Publications (DOS) No. 2,502,832 and (DOS) No. 2,502,833, for example, disclose such an arrangement for effecting reversible movements. The arrangement causes an indirect reversing by means of a pressure medium circuit which is supplied by an auxiliary pressure medium source having a constant delivery capacity. The pressure medium circuit adjusts the reversing mechanism of a pump by means of a servovalve. The manufacturing costs of such an apparatus are still too large in view of the limited exactness which may be attained.

OBJECTS OF THE INVENTION

In view of the foregoing it is the aim of the invention to achieve the following objects singly or in combination:

- to provide a digitally compatible servomotor which may be directly and operatively connected to a reversible, digital stepping motor;
- to provide a servomotor which achieves a high degree of accuracy between the master or rated value setting and the actually attained or slave setting;
- to provide a servomotor suitable for use with substantially any type of stepping motor which satisfies the required degree of accuracy and dynamic characteristics, for example, a hydraulic or pneumatic stepping motor;
- to make sure that the rated position corresponds precisely to the actual position even under high load operating conditions; and
- to provide a servomotor having good dynamic characteristics.

SUMMARY OF THE INVENTION

The present digitally compatible servomotor with a reversible, digital stepping motor has a spindle with a relatively high pitch cooperating with the working piston of the servomotor. One end of the spindle is rigidly coupled to a control disk system centrally arranged in a cylinder relative to the longitudinal axis of the piston cylinder. A digital stepping motor is operatively connected to the servomotor by means of a coupling element. The digital stepping motor has two opposingly toothed indexing disks interconnected and driven by a hydraulic claw or clutch system. In the standstill or rest condition the indexing disks are locked in position. Additional features of the invention are described below and in the claims.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
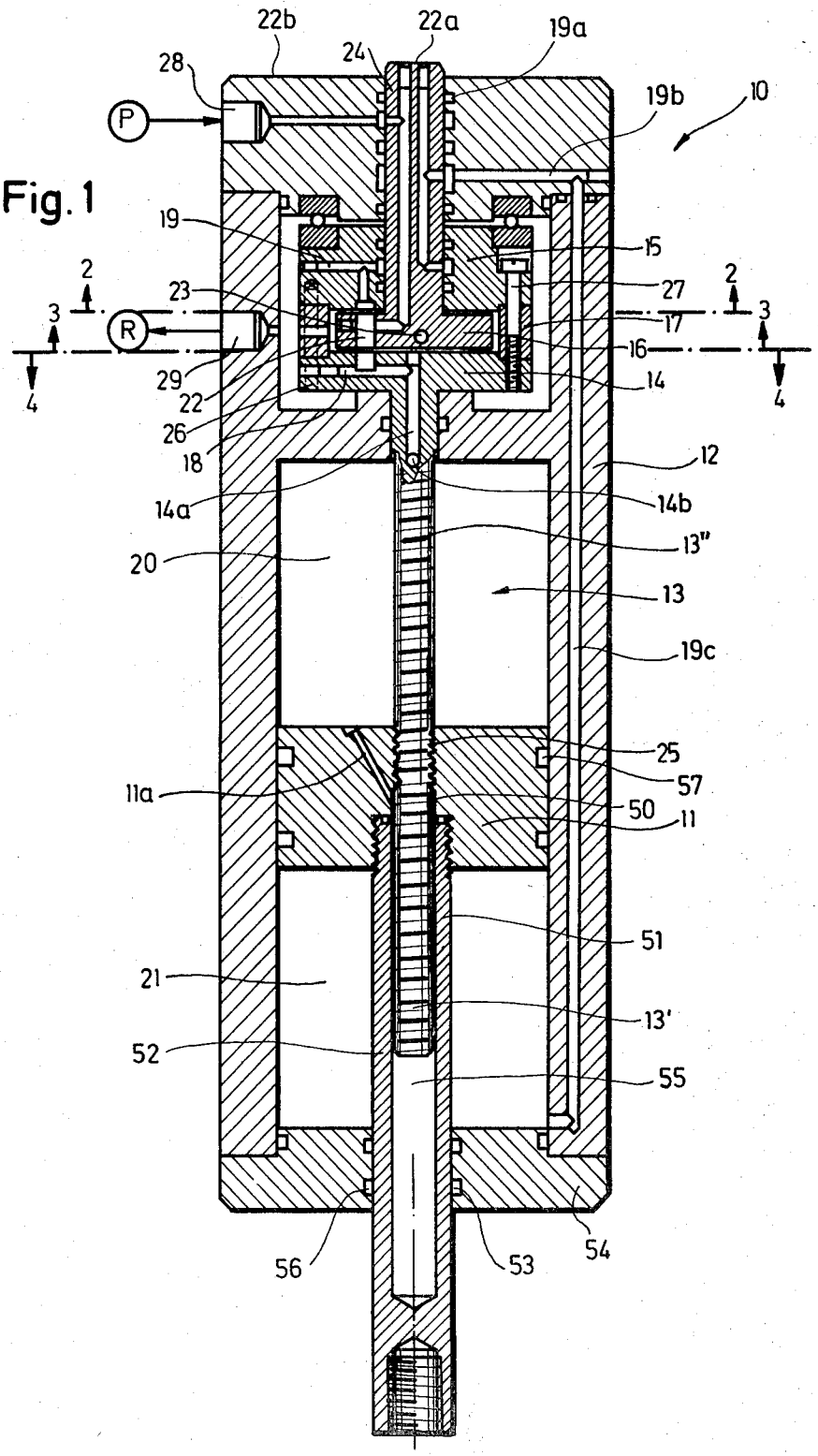
FIG. 1 illustrates a sectional view of the servomotor of the invention along the longitudinal axis of the servomotor.
Figure 2:
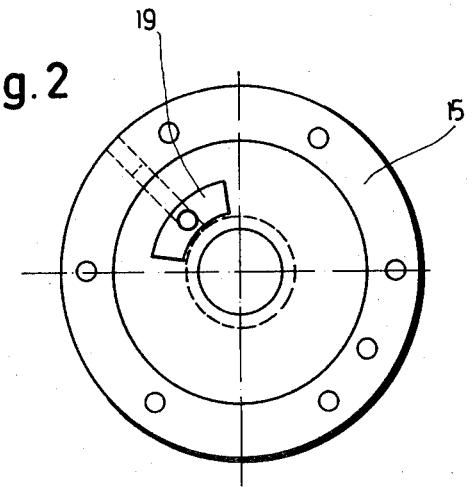
FIG. 2 shows a view of the first, outer or upper control disk looking onto the plane defined by the line 2—2 in FIG. 1.
Figure 3:
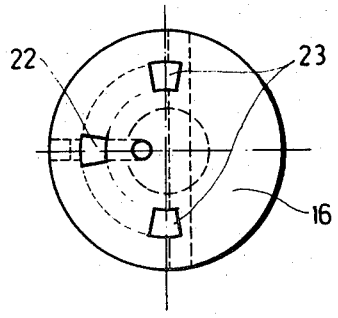
FIG. 3 illustrates a view of the second, central control disk looking onto the plane defined by the line 3—3 in FIG. 1.
Figure 4:
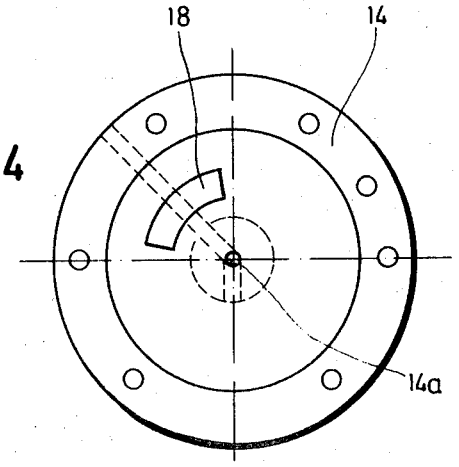
FIG. 4 illustrates a view of the third, outer or lower control disk looking onto the plane defined by the line 4—4 in FIG. 1.

FIG. 1 shows an example embodiment of a servomotor 10 according to the present invention. The servomotor 10 has a working piston 11 operatively arranged in a servocylinder 12. The piston 11 is secured against rotation in the cylinder 12 but the piston can slide up or down relative to the longitudinal axis of the cylinder 12. In contrast to known types of servomotors, the servomotor according to the present invention is constructed so that the axial movement of the working piston 11 within the servocylinder 12 rotates a spindle 13 having a sufficiently high pitch to avoid self-locking.

The angle of rotation of the spindle 13 is very accurately determined corresponding to the position of the working piston 11 in the servocylinder 12. One end 13' of the spindle 13 extends into and through a threaded bore 25 in the working piston 11. The other end 13'' of the spindle 13 is rigidly attached to a control disk system comprising the control disks 14, 15, and 16. The working piston 11 has a connecting bore **11*a* which extends from the upper working chamber 20 to an annular chamber 50 in the piston 11 around the spindle 13. This connecting bore 11*a* is operatively connected to the lower chamber 21 through said annular chamber 50 and through a slot 51 in the output piston rod 52 whereby the required volume matching may be accomplished. The output piston rod 52 extends slidingly through a hole 53 in the lower cover 54 of the cylinder 12. The piston rod 52 has an axial hole 55 into which the lower end 13' of the spindle 13 may extend. The lower cover 54 is provided with conventional seals 56. Similarly, the piston 11 is also provided with conventional sealing piston rings 57**.

The axial movement of the working piston 11 rotates the spindle 13 which in turn rotates a control disk system comprising the axially centered control disks 14, 15 and 16. The two outer control disks 14 and 15 of the control disk system are connected to each other by bolts 27 and a locating pin 26. Further, plates 14, 15 are rigidly attached to the spindle 13. This connection occurs through a high precision parallel machined spacing bushing 17. The facing sides of the central control disk 16 are machined so exact, that it fits between the outer control disks 14, 15 substantially free of play. The control disk 14 which is rigidly attached to the spindle 13, has a central bore 14*a* extending into the piston chamber 20 of the cylinder 12 thus providing a hydraulic connection between the control disk 14 and the piston chamber 20.

The control disk system described above is constructed so that the surface pressure ratio between the pressures at both surfaces of the working piston 11 is controlled as a function of the angular position of the inner or central control disk 16 relative to the position of the outer control disks 14, 15. For this purpose, both of the outer rigidly interconnected control disks 14, 15 have a control slot 18, 19 respectively. The slot 18 of the disk 14 is connected to a respective piston cylinder chamber 20 through the ducts 14*a* and 14*b*. The slot 19 is connected through the ducts 19*a*, 19*b*, 19*c* to chamber 21. The middle control disk 16 is provided with a control slot 22, which is connected through the ducts 22*a*, 22*b* to the system pressure represented by the pump P in FIG. 1. The middle control disk 16 has two further control slots 23 which are connected to the low pressure, that is, to the return flow path R in FIG. 1, leading to a sump reservoir or the like which may be vented to the atmosphere.

In the neutral position of the control disk system 14, 15, 16 of the present invention, the overlapping between the pressure loaded control slot 22 of the central control disk 16, and the control slots 18, 19 of the outer control disks 14, 15 corresponds exactly to the overlapping of the return control slots 23. Furthermore, when the control disk system is in the neutral position, the overlappings of the control slots 18 and 19 relative to the control slot 22 are equal to each other. In operation, if the control disk system is now removed from the neutral position, for example, by rotating the central control disk 16, then the system pressure from the pump P is transferred to the piston chamber 20 or 21 through the central control disk 16 and the corresponding outer control disks 14 or 15. The resulting pressure differential between the piston cylinder chambers 20 and 21 causes a stroke movement of the working piston 11 because the respective opposing piston cylinder chamber is connected to the low pressure side of the system by means of the respective outer control disk 14 or 15 and the central control disk 16. Both outer control disks 14, 15 are simultaneously rotated by the stroke movement of the working piston 11 until the neurtral positioning of the control disk system is restored. Thus, an unambiguous correlation exists between the angle of rotation of the central control disk 16 and the position of the working piston 11. The foregoing is also true if the neutral position is now removed, for example, by external power impacts on the working piston 11 and hence by a rotating of the outer control disks 14, 15, whereby the control operation described above, repeats itself. The working piston 11 moves automatically to its predetermined position.

Figure 5:
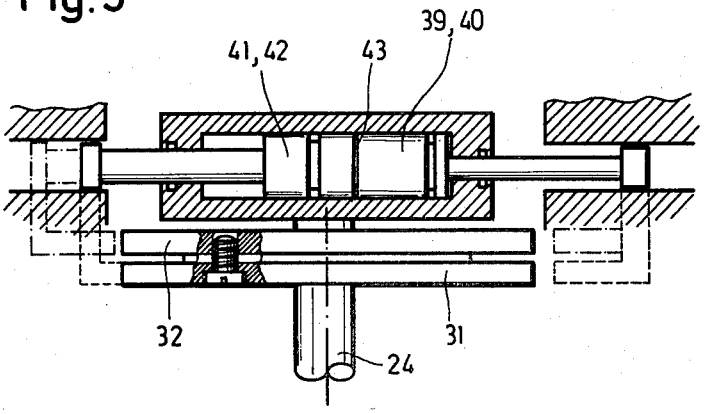
FIG. 5 shows a side view of the present stepping motor partially in section.
Figure 6:
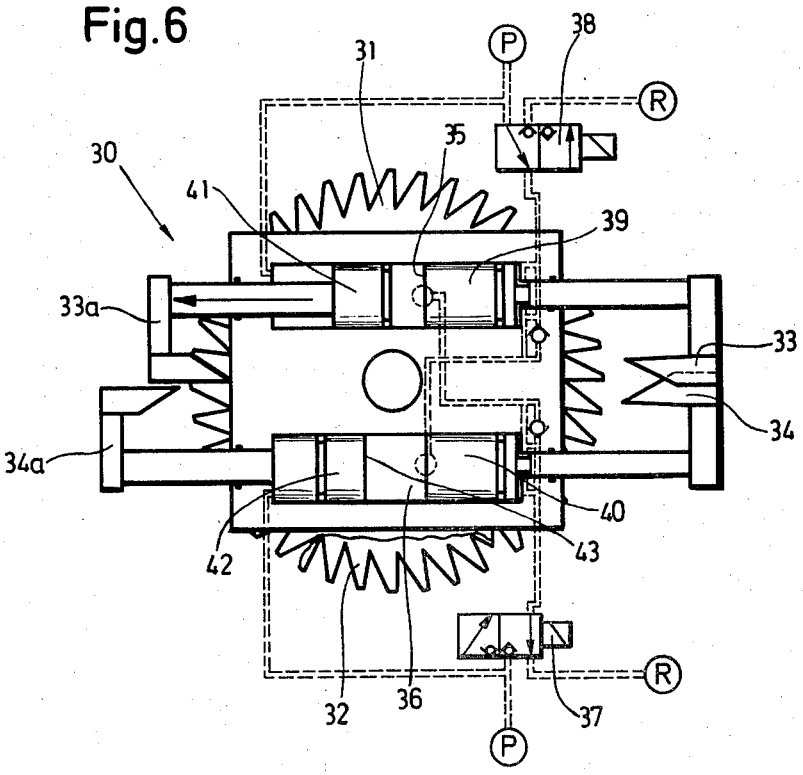
FIG. 6 shows a top view of the stepping motor of FIG. 5 with portions removed to simplify the illustration.

The central control disk 16 is adjusted or stepped by the digital stepping motor 30 shown in FIGS. 5 and 6. The stepping motor 30 is rigidly connected to the central control disk 16 through the connecting element 24. The stepping motor 30 makes certain that the working piston 11 always assumes the selected position. The stepping mechanism is stepped in the desired direction by an exactly defined increment in response to a corresponding concrete, digital control impulse. The working piston 11 may be exactly displaced by a definite distance increment, which is determined by an exactly defined number of the smallest partial steps if the stepping motor 30 is triggered by an equally defined number of corresponding control impulses. As long as the boundary or rather limiting conditions, such as the minimum system pressure and the maintaining of the control impulse duration, are satisfied, it may be assumed that the applied control impulses are actually effective. Consequently, a check or return report signal is unnecessary.

FIGS. 5 and 6 illustrate the stepping motor 30 of the present invention which comprises several toothed disks or wheels 31, 32 connected together and having saw teeth with opposing slopes as shown in FIG. 6. Each of these wheels 31, 32 is rotated by a corresponding ratchet or claw arrangement 33, 34. In the rest condition the wheels 31, 32 are locked in position. In operation, a control signal, which may, for example, be an electrical, a mechanical or a pneumatic impulse, is applied to a very fast acting control valve 37 or 38 which opens the path for the system pressure from the pump P and loads the controlled piston of either the piston cylinder system 35 or 36. Each of the two piston cylinder systems 35, 36 comprises a controlled piston 39 or 40 and a piston 41 or 42 loaded by a constant pressure, for example, the system pressure from the pump P. The controlled piston 39 or 40 is now displaced by the pressure loading through the control valve 37 or 38, against the force of the associated constant load piston 41 or 42. This opposing displacement occurs because the effective piston area of the controlled piston 39 or 40 is nearly twice as large as the corresponding effective piston area of the constant load piston 41 or 42.

Simultaneously, the separating area 43 between a controlled piston and the respective constant load piston of one system 35 or 36 is loaded with pressure by one of the above mentioned control valves 37 or 38. Since the separating surface 43 is substantially larger than the constant loaded surface and the controlled surface, the pistons 39, 40 or 41, 42 of the respective other system are fully extended as indicated by the corresponding arrow, whereby the appropriate wheel 31 or 32 of the respective system is disengaged.

The controlled piston 39 or 40 of the pressure loaded systems 35 or 36 now moves until the claw 33 or 34 engages with saw tooth of the corresponding indexing wheel 31 or 32. Just prior to this engaging of the claw 33 or 34 with the corresponding wheel 31 or 32, however, the claw 33*a* or 34*a* of the constant load piston 41 or 42 has disengaged itself from the respective tooth gap. The controlled piston 39 or 40 now rotates the wheel 31 or 32 by an exact amount, until the corresponding claw 33 or 34 engages in the tooth gap. In other words, the respective wheel is rotated by a distance corresponding to half a tooth pitch. If the control impulse for the control valve 37 or 38 is discontinued, then the surface of the controlled piston 39 or 40 of the respective system 35 or 36 is connected with the return path R. The constant load piston 41 or 42 then rapidly retracts whereby the opposing, controlled piston 39 or 40 is extended. The claw 33*a* or 34*a* of the constant load piston 41 or 42 now moves the wheel 31 or 32 exactly until the claw engages the tooth gap.

Only when the controlled piston 39 or 40 is in a position just before its neutral position, that is, when the controlled piston 39 or 40 is fully extended, will the separating surface 43 of the respective other system be connected to the return flow path R. In prior art systems this connection had to be prevented by a non-return or check valve. Further, the constant pressure loaded piston 41 or 42 of the present system retracts until the corresponding claw 33*a* or 34*a* engages in the tooth gap of the wheel 31 or 32.

The present stepping motor 30 is secure against rotation in both directions. In other words, each control impulse applied to one or the other control valve 37 or 38 will cause the stepping motor 30 to move by a whole tooth pitch in one direction or the other and rotation in the unintended direction is prevented. The stepping mechanism of the present invention no longer requires monitoring and answer back features. Additional stepping motors may be superimposed on the stepping motor 30. These stepping systems are mechanically connected to one another so that they perform either as an adder or as a differentiating combination. Such a capacity increase of the present stepping motor results on the one hand in an increased accuracy in the positioning of the working piston 11. On the other hand, the maximum operating speed attainable heretofore, has also been increased for the working piston 11. In addition, a considerably improved dynamic control characteristic of the servomotor has also been achieved. If, for example, a high positioning accuracy and a high operating speed of the servomotor is required, then the piston stroke may be divided into m-number of large increments, which correspond to m-positions of one stepping motor. Each of the m-number of positions is in turn subdivided into n-number of smaller increments, which correspond to n-positions of another stepping motor. The stepping or triggering of the stepping motors with m increments or positions and the stepping of the stepping motor with n increments or positions occurs simultaneously.

Furthermore, the wheel 31 or 32 of the stepping motor 30 may be provided with a division or stepping positions corresponding to a particular operation program. Hence, the servomotor 10 is programmable.

The above described features provide a digitally compatible, hydraulic or pneumatic servomotor combined with a stepping motor which, due to its structural features assures a very high degree of accuracy, whereby the required rated or master position corresponds very exactly to the actually attained slave position even under heavy load conditions. The control elements integrated in the control or servo cylinder 11 are constructed with due regard to the high control requirements which the servomotor must meet whereby a high degree of exactness or master-slave correspondence and good dynamic characteristics are achieved.

The servomotor constructed in accordance with the invention as described above is suitable for combination with computers without any additional D/A conversion. The direct access to the control elements, however, also makes possible to operate the present servomotor by means of analog control signals. A direct manual control is also possible, for example, in connection with farm machinery and construction machinery.

Although the invention has been described with reference to specific example embodiments, it is to be understood, that it is intended to cover all modifications and equivalents within the scope of the appended claims.

What is claimed is:

1. A digitally compatible servomotor comprising, stepping motor means (30), servocylinder means (12) including first and second chamber means, piston means (11) axially slidable in said first chamber means of said servocylinder means, threaded spindle means (13) operatively engaging said piston means (11), control disk means (14, 15, 16) operatively arranged in said second chamber means of said servocylinder means in axial alignment with said threaded spindle means, one end of said threaded spindle means being rigidly connected to said control disk means, connector means (24) operatively connecting said stepping motor means (30) to said control disk means, said stepping motor means comprising two oppositely toothed operatively interconnected ratchet wheel means, and hydraulically operable claw means operatively arranged for driving said ratchet wheel means and for locking said ratchet wheel means in a rest position.

2. The servomotor of claim 1, wherein said control disk means comprise three disks (14, 15, 16) including two outer disks and a central disk (16), means (17, 26, 27) operatively connecting the two outer disks which are rigidly connected to said threaded spindle means.

3. The servomotor of claim 2, wherein said central disk (16) is operatively interposed between the two outer disks (14, 15) substantially without play.

4. The servomotor of claim 2, wherein said first chamber in said servocylinder is divided into two chamber portions (20, 21), said outer control disks having control slot means (18, 19), and conduit means operatively connecting said control slot means to the respective one of said chamber portions.

5. The servomotor of claim 2, wherein said central control disk (16) comprises first control slot means (22) operatively connected to a pressure source, and second control slot means (23) operatively connected to a return flow path.

6. The servomotor of claim 2, wherein said connector means (24) operatively connect said central disk (16) to said stepping motor means, whereby said connector means extend through one of said outer disks, and wherein said stepping motor means is reversible.

7. The servomotor of claim 1, wherein said stepping motor means comprise two operating piston cylinder systems (35, 36) each including a respective control valve means (37, 38), one of said two ratchet wheels in the form of a toothed disk, and the respective one of said claw means for driving and locking the respective toothed disk.

8. The servomotor of claim 7, wherein each of said piston cylinder systems of the stepping motor means comprises a controlled piston means and a constant pressure loaded piston means.

9. The servomotor of claim 1, wherein said stepping motor means and said servocylinder means form a structural unit.

10. The servomotor means of claim 1, wherein stepping motor means comprise a plurality of stepping motors operable by any desired drive input, for example, an electric drive input.

* * * * *